US007318579B1

(12) United States Patent
Novoa

(10) Patent No.: US 7,318,579 B1
(45) Date of Patent: Jan. 15, 2008

(54) LADDER HOIST ASSEMBLY

(76) Inventor: Pablo Raba Novoa, 4774 NW. 5th Pl., Coconut Creek, FL (US) 33063

( * ) Notice: Subject to any disclaimer, the term of this patent is extended or adjusted under 35 U.S.C. 154(b) by 0 days.

(21) Appl. No.: 11/311,086

(22) Filed: Dec. 19, 2005

(51) Int. Cl.
*B66D 1/28* (2006.01)

(52) U.S. Cl. ..... 254/278

(58) Field of Classification Search ..... 254/278, 254/281, 284, 324, 329
See application file for complete search history.

(56) References Cited

U.S. PATENT DOCUMENTS

| | | | | |
|---|---|---|---|---|
| 731,708 | A | 6/1903 | Quinn | |
| 2,405,505 | A | 8/1946 | Kleidon | |
| 2,459,621 | A | 1/1949 | Cobb | |
| 3,266,746 | A * | 8/1966 | Brown et al. | 242/573.9 |
| 3,910,184 | A * | 10/1975 | Springer | 101/116 |
| 3,977,652 | A | 8/1976 | Mauch | |
| D260,754 | S | 9/1981 | Gunnels | |
| 4,390,161 | A | 6/1983 | Nelson | |
| 4,598,795 | A | 7/1986 | Larson | |
| 4,771,988 | A * | 9/1988 | Scroggins, Sr. | 254/336 |
| 5,310,152 | A * | 5/1994 | O'Neill | 248/329 |
| 6,098,748 | A * | 8/2000 | Harper et al. | 182/129 |
| 6,244,381 | B1 | 6/2001 | Ruble | |
| 6,494,437 | B1 * | 12/2002 | Boyer | 254/323 |
| 6,520,723 | B2 * | 2/2003 | Christensen | 410/100 |
| 6,607,053 | B1 * | 8/2003 | Warren | 182/106 |
| 6,652,205 | B2 * | 11/2003 | Christensen | 410/100 |

FOREIGN PATENT DOCUMENTS

| | | | | |
|---|---|---|---|---|
| DE | 1946797 | * | 4/1970 | 254/278 |

* cited by examiner

*Primary Examiner*—Emmanuel M Marcelo
(74) *Attorney, Agent, or Firm*—Malloy & Malloy, P.A.

(57) ABSTRACT

A hoist assembly for use with an elevating device, such as a ladder, comprises a base structured for mounting the hoist assembly to the ladder or other elevating device. The hoist assembly includes a spool which is disposed in a normally secured orientation relative to the base, and includes an elongated member, such as a rope, wire, line, etc. attached thereto and movable therewith. A release mechanism is provided to permit the spool to be at least temporarily released from its normally secured orientation, thereby allowing the spool and the elongated member affixed thereto to move relative to the base, for example, in a rotating manner. The release mechanism includes a cogwheel having one or more cogs structured to engage a release plate structured to retain the spool in its normally secured orientation relative to the base.

20 Claims, 5 Drawing Sheets

LADDER HOIST ASSEMBLY

BACKGROUND OF THE INVENTION

1. Field of the Invention

The present invention is directed to a hoist assembly structured to be used with a ladder or other elevating device to allow a single user to raise or lower a large, awkward, and/or heavy object to or from an elevated location, respectively, without assistance. The hoist assembly includes a release mechanism having an actuator structured to temporarily release a spool from a normally secured orientation relative to a base thereby allowing the user to rotate the spool freely to raise or lower the object via an elongated member such as, by way of example, a wire, rope, or cable. The release mechanism is further structured to automatically return and retain the spool in the normally secured orientation upon release of the actuator, thereby preventing movement of the spool, the elongated member, and any object attached thereto, while the actuator is not being operated.

2. Description of the Related Art

Elevating devices, such as ladders, lifts, scaffolds, positionable staircases, etc., are commonly used to allow a person to reach an elevated location. Oftentimes, work must be performed at the elevated location, wherein the work may include new construction, maintenance, and/or repair, just to name a few. Thus, it is common for work materials to be required at elevated locations where work is to be performed. The materials which may need to be raised to an elevated location include, but are in no manner limited to, tools, paints, tiles, shingles, tarps, windows, shutters, plywood, drywall, etc. Further, it is not uncommon for a person to attempt to perform work at an elevated location by themselves, elevating the work material(s) to the location and performing the work required without assistance, thereby presenting a number of practical and safety issues related to the person undertaking such an effort alone.

Several devices have been developed in attempts to address these important practical and safety concerns including devices which utilize the side rails of a ladder as a track to guide a truck, carriage, or other support device up the sides of the ladder, wherein the truck or other support device is structured to support and transport one or more objects to an elevated location proximate an upper end of the ladder. A significant disadvantage of these devices is that the truck, carriage, or other support device travels along the side of the ladder on which a user must climb, thereby providing an obstacle for the user to pass and, more importantly, they present a potential safety hazard in the form of the truck, carriage, support device, or object(s) transported thereon dropping down onto a user positioned below either at the base of the ladder or attempting to ascend the same.

Other devices have been developed having a support structure that simply slides over one or more rungs of the ladder and includes a generic lifting mechanism, such as a winch or pulley, to assist in lifting an object. These devices do not, however, address specific structure to maintain the generic lifting mechanism in a fixed, immobile, and secure configuration until such time as a user elects to raise or lower an object utilizing the lifting mechanism. One such device requires a user to secure a free end of a rope or cable attached to the object and passed over a pulley, which may be difficult and/or dangerous if the user is positioned on or below the ladder while raising or lowering an object.

Hoist or winch mechanisms which utilize a complex series of interlocking gears or similar components structured and arranged to maintain an object attached to a line or cable interconnected to the lifting mechanism in a stationary position often require significant additional effort and energy by the person to raise or lower an object to overcome the components which are designed to keep the line or cable stationary.

As such, it would be beneficial to provide a hoist assembly structured to be used with a ladder or other elevating device to allow a single user to raise or lower a large, awkward, and/or heavy object to or from an elevated location, respectively, without assistance. Further, it would be preferable for any such assembly to avoid incorporation of the disadvantages inherent in the various devices described above.

SUMMARY OF THE INVENTION

The present invention is directed to a hoist assembly which is structured to facilitate raising or lowering one or more objects to or from an elevated location as may be required to perform various tasks, such as, construction, maintenance, and/or repairs, by a single user without assistance. As such, the hoist assembly of the present invention is also structured to be utilized with an elevating device to access an elevated location such as, by way of example only, a ladder.

To facilitate use with an elevating device, the hoist assembly of the present invention comprises a base which is structured to be mounted to the device. In addition, the hoist assembly comprises a spool interconnected to the base, wherein the spool is structured and disposed in a normally secured orientation relative to the base. More in particular, the base comprises a plurality of spool supports each having a support channel which is structured to receive a portion of the spool movably therein. In at least one embodiment, the support channels comprise an aperture wherein the spool is disposed movably therethrough. Additionally, at least one of the plurality of spool supports comprises a release plate. The release plate includes at least one release channel thereon, and in at least one embodiment, the release plate comprises a plurality of release channels disposed thereon. In one further embodiment, as discussed in more detailed below, the release plate comprises a plurality of release channels disposed in an array around the support channel, and in yet another embodiment, the plurality of release channels are disposed completely through the release plate.

The hoist assembly of the present invention also comprises a release mechanism structured to retain the spool in the aforementioned normally secured orientation relative to the base. More in particular, the release mechanism comprises a cogwheel which is interconnected to the spool, the cogwheel being structured and normally disposed in an operative engagement with the release plate. Specifically, in at least one embodiment, the cogwheel includes at least one cog extending outwardly therefrom, and the operative engagement is at least partially defined by the at least one cog being disposed in an interlocking relation with the at least one release channel, thereby retaining the spool in its normally secured orientation relative to the base.

Additionally, the release mechanism of the present invention comprises an actuator which is operable by a user to temporarily release the spool from its normally secured orientation thereby at least temporarily allowing the spool to be movable relative to the base. Further, the release mechanism is structured to automatically return and retain the spool in the normally secured orientation relative to the base upon release of the actuator by the user. To facilitate this operation, the release mechanism, in at least one embodiment, comprises a piston which is interconnected to the cogwheel wherein the piston is structured to normally bias the cogwheel into an operative engagement with the release plate. The release mechanism of this embodiment further comprises a biasing element structured to engage a portion of the piston and force the piston towards the release plate so as to normally bias the cogwheel, which is interconnected to the piston, into the aforementioned operative engagement with the release plate.

In order that the hoist assembly of the present invention may be utilized to raise or lower one or more objects to or from an elevated location, respectively, the hoist assembly includes an elongated member, such as a cable, rope, line, or wire, interconnected to the spool and movable therewith. The cable is secured to at least a portion of the spool at one end, and has one or more attachment members secured to an opposite end to facilitate attachment to the one or more objects to be lifted.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As indicated above, the present invention is directed to a hoist assembly, generally as shown as 10 throughout the figures, which is structured to be utilized by a single user to facilitate raising or lowering one or more objects to or from an elevated location, respectively. In one embodiment, the hoist assembly 10 of the present invention is structured to be utilized by one user to raise work materials such as, by way of example only, tools, tiles, shingles, tarps, paints, plywood, drywall, lights, signage, etc., to an elevated location as may be required to perform one or more building, maintenance, and/or repair function, just to name a few. It will be appreciated that the present invention may be utilized to raise or lower any number of other materials to or from an elevated location as may be required by any of a variety of other purposes. As such, the hoist assembly 10 of the present invention is structured to be attached to an elevating device to provide a user access to an elevated location, such as a ladder, scaffolding, or other known elevating device.

Figure 1:
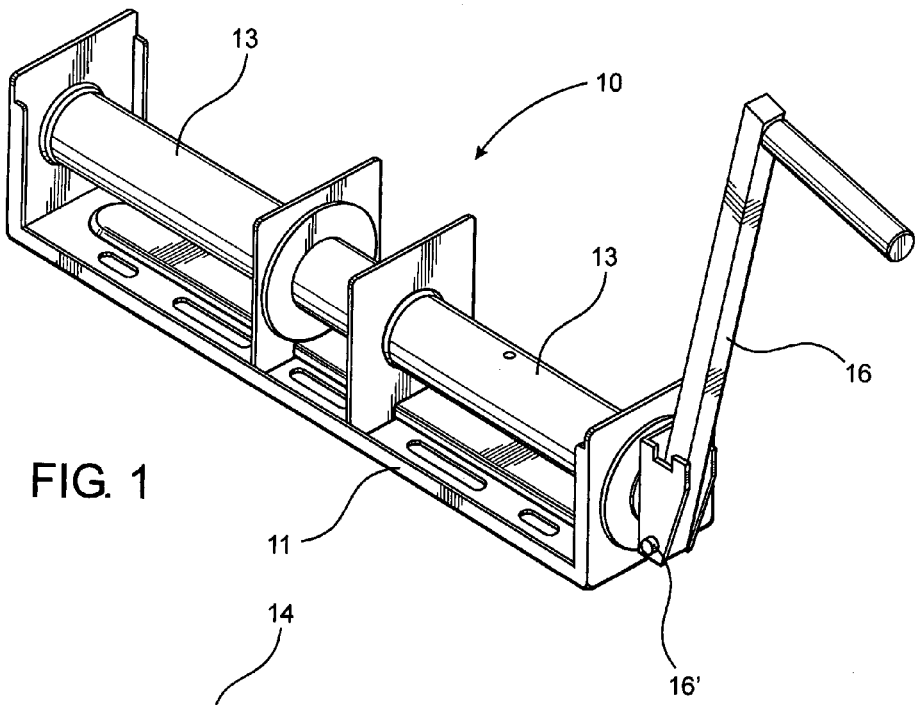
FIG. 1 is a perspective view of one preferred embodiment of the hoist assembly of the present invention.
Figure 2:
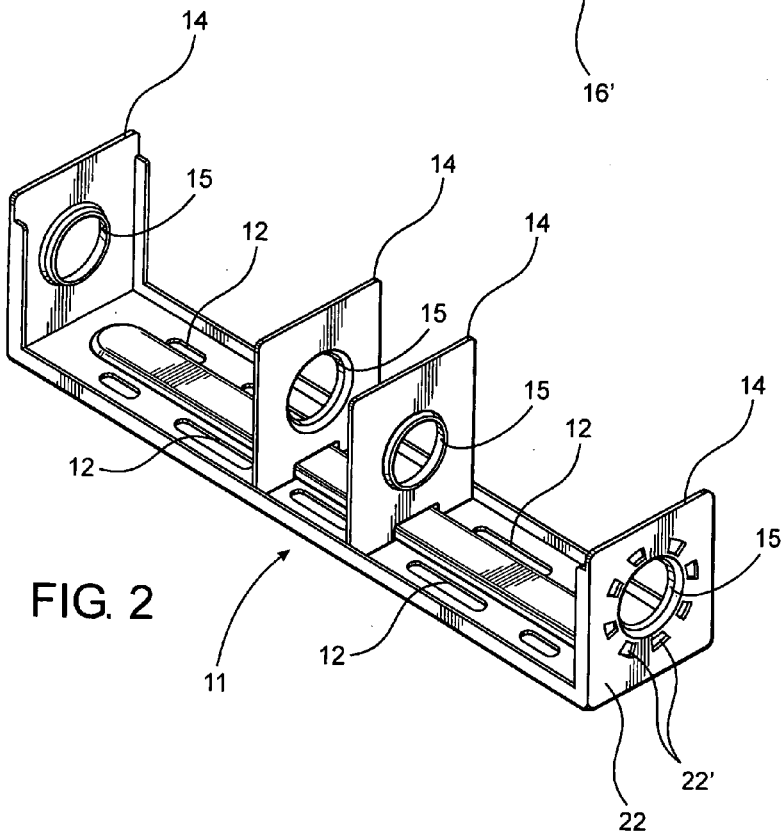
FIG. 2 is a perspective view of a base in accordance with the preferred embodiment of FIG. 1.
Figure 3:
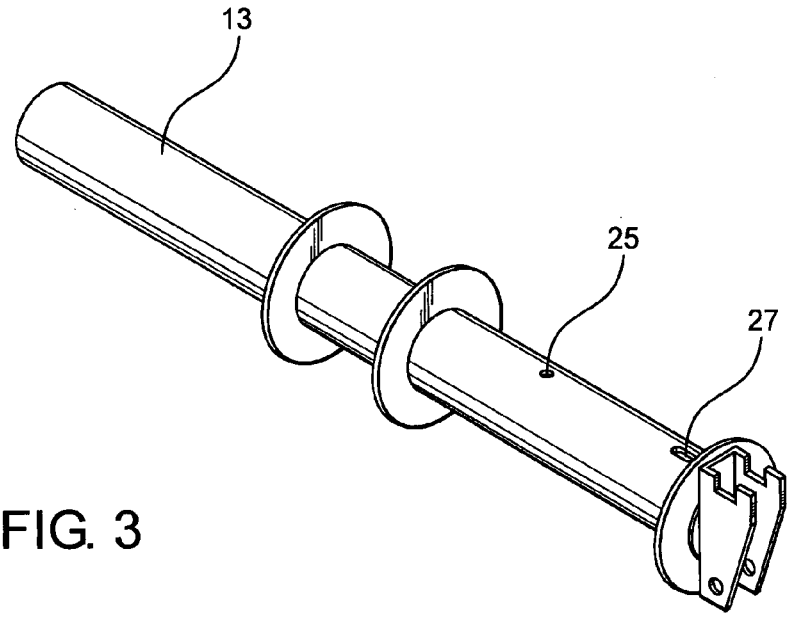
FIG. 3 is a perspective view of a spool in accordance with the preferred embodiment of FIG. 1.

To facilitate mounting the hoist assembly 10 of the present invention to an elevating device such as, for example, a ladder, the hoist assembly 10, comprises a base 11 structured to be mounted to the ladder or other elevating device. As such, the base 11 in one preferred embodiment of the present invention comprises at least one mounting channel 12 structured to facilitate mounting the base 11 to at least a portion of the elevated device such as, by way of example, one of the plurality of rungs of the ladder. In addition, the hoist assembly 10 of the present invention comprises at least one mounting member 12' which is structured to cooperatively associate with the at least one mounting channel 12 and the portion of elevating device, such as one or more rungs of a ladder, to facilitate securely mounting the hoist assembly 10 of the present invention thereto. In at least one embodiment, the base 11 comprises a plurality of mounting channels 12, as illustrated in FIG. 2, to facilitate mounting the base 11 to a ladder or other elevating device.

Figure 8:
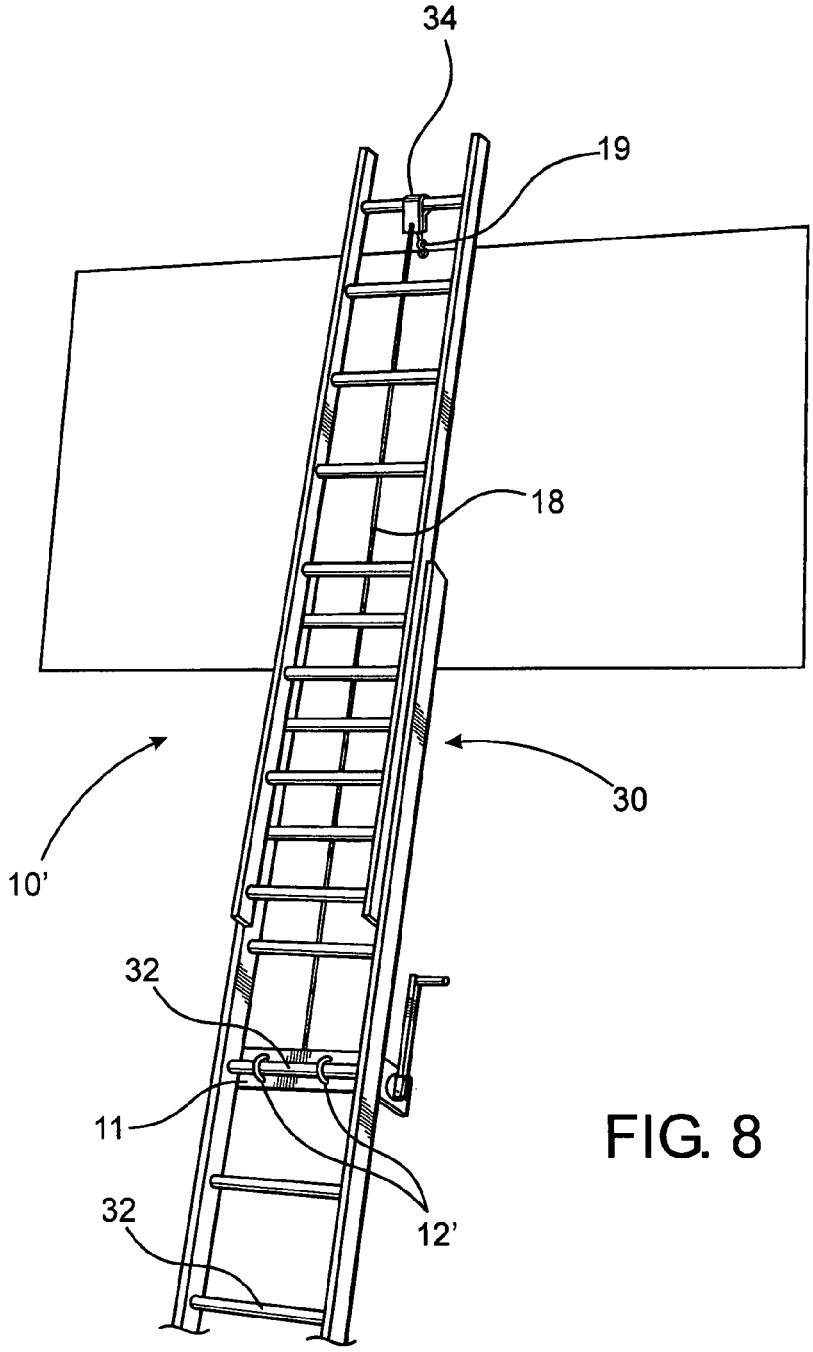
FIG. 8 is a perspective view of a preferred embodiment of the hoist assembly of the present invention mounted to a ladder and interconnected to a large and heavy object being lifted by the assembly.

In one preferred embodiment, a plurality of mounting members 12' are provided wherein each of the mounting members 12' is structured to cooperatively associate with one of the plurality of mounting channels 12 of the base 11 and at least one of the plurality of rungs of a ladder 30, as represented in FIG. 8, to facilitate securely mounting the hoist assembly 10 to the ladder. 30. As also illustrated in FIG. 8, the mounting members 12' in a preferred embodiment comprise a U-shaped orientation thereby facilitating the cooperative association with one or more of the rungs of the ladder.

The hoist assembly 10 of the present invention further comprises a spool, generally shown as 13 throughout the figures, which is interconnected to the base 11. The spool 13 is structured and disposed in a normally secured orientation relative to the base 11. Specifically, in a preferred embodiment, the spool 13 is structured such that it is normally secured and immovable relative to the base 11 under normal operating conditions.

To facilitate interconnection of the spool 13 to the base 11 of the hoist assembly 10, the base 11 comprises at least one spool support 14 having at least one support channel 15 which is structured to receive a portion of the spool 13 movably therein. In one preferred embodiment, the base 11 comprises a plurality of spool supports 14, each comprising at least one support channel 15, such as is illustrated in FIG. 2. In addition, FIG. 2 shows that in a preferred embodiment the support channels 15 comprise an aperture having a generally circular configuration. Additionally, to facilitate disposition of the spool 13 in the normally secured orientation relative to the base 11, at least one of the spool supports 14 comprises a release plate 22, as illustrated best in FIG. 2, and as discussed in detail below.

The hoist assembly 10 of the present invention also includes a release mechanism 20 which is structured to retain the spool 13 in a normally secured orientation relative to the base 11 thereby allowing a single user to utilize the present invention to raise or lower one or more heavy and/or large and/or awkward objects to or from an elevated location such as maybe required to perform a particular task such as, but not limited to, the tasks enumerated above.

Figure 4:
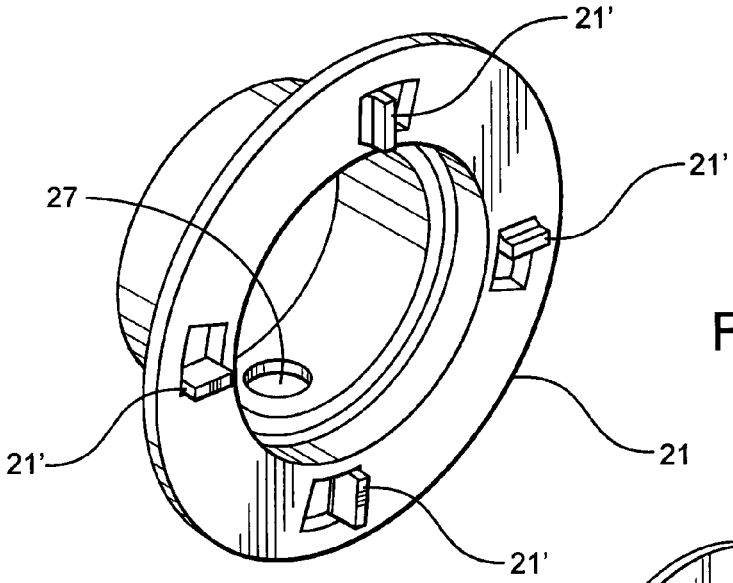
FIG. 4 is a perspective view of a cogwheel in accordance with the preferred embodiment of FIG. 1.
Figure 5:
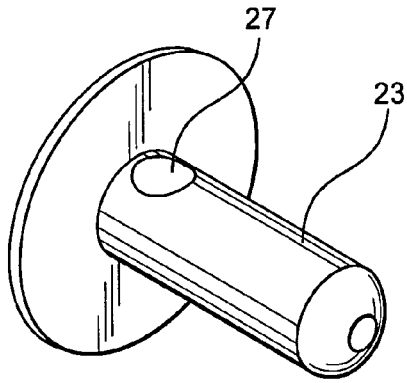
FIG. 5 is a perspective view of a piston in accordance with the preferred embodiment of FIG. 1.

The figures illustrate the release mechanism 20 comprising a cogwheel 21 which is structured to be normally disposed in an operative engagement with the release plate 22, as noted above. FIG. 4 illustrates one preferred embodiment of the cogwheel 21 of the present invention comprising a plurality of cogs 21' extending outwardly therefrom. More in particular, the plurality of cogs 21, are structured and disposed about the cogwheel 21 in an arrangement corresponding to an arrangement of a plurality of release channels 22' disposed on the release plate 22 of the base 11 of the present invention. As such, when the cogwheel 21 is disposed in an operative engagement with the release plate 22, each of the plurality of outwardly extending cogs 21' is structured and disposed to engage a corresponding one of the plurality of release channels 22' in an interlocking relation. More in particular, in one preferred embodiment of the present invention, the interlocking relation between each of the plurality of cogs 21' and the plurality of release channels 22' is at least partially defined by each cog 21' extending into a corresponding one of the release channels 22' on the release plate 22.

Figure 6:
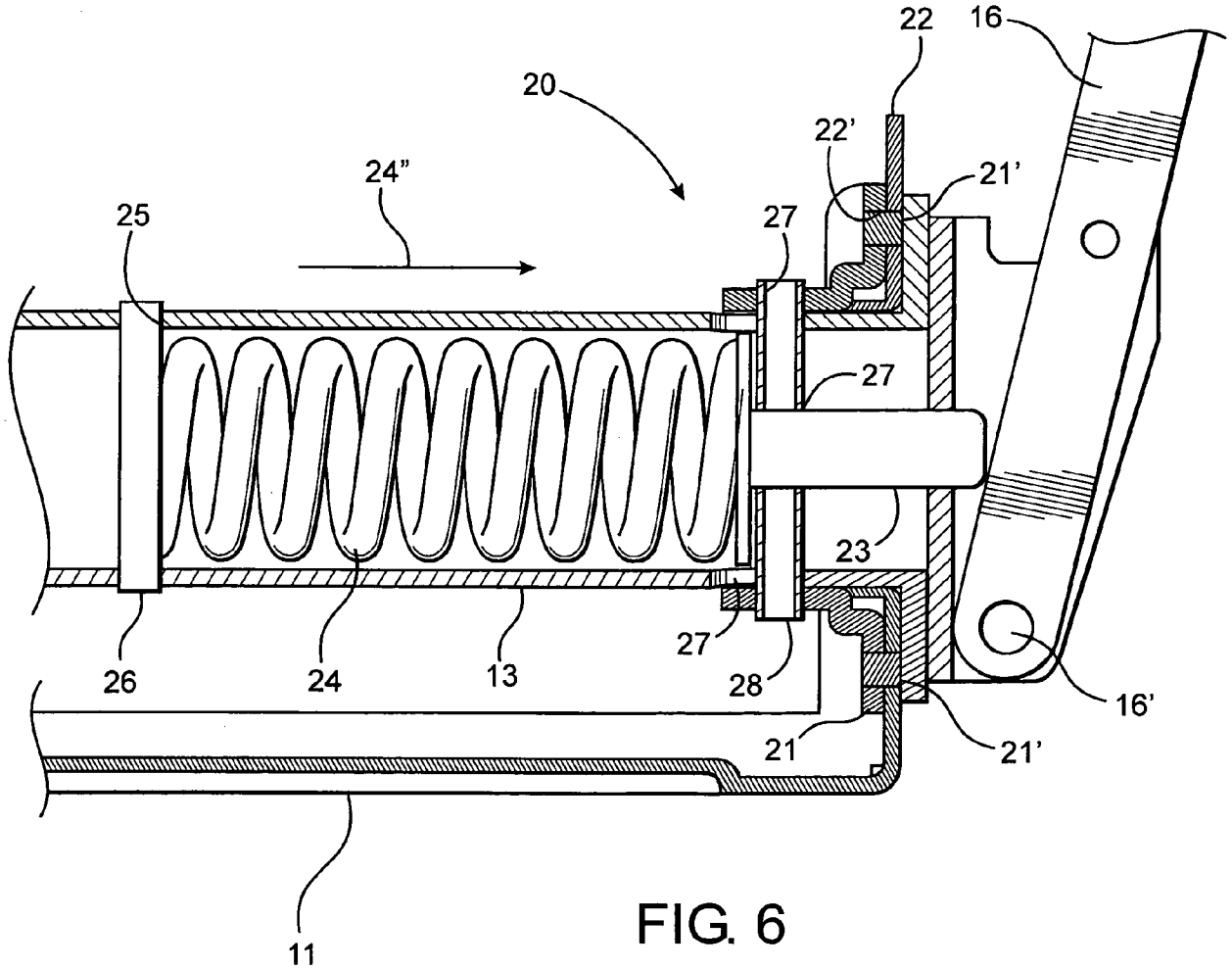
FIG. 6 is a partial cross-sectional elevation of a preferred embodiment of a release mechanism in accordance with the present invention illustrating a spool disposed in a normally secured orientation with a base.

As best shown in FIG. 2, in a preferred embodiment, each of the plurality of release channels 22' are structured and disposed as apertures through the release plate 22. As will be appreciated, the interlocking relation is further defined by each of the plurality of cogs 21' extending into a corresponding one of the plurality of release channels 22' disposed on the release plate 22 such that each of the cogs 21' extends substantially into a corresponding release channel 22' of the release plate 22, as illustrated in FIG. 6. In this manner, each of the plurality of cogs 21' are immovable from the corresponding release channel 22' on the release plate 22 until the cogwheel 21 is disposed a predetermined distance from the release plate 22. More specifically, the predetermined distance being greater than the distance by which the plurality of cogs 21' extend into the corresponding release channels 22'.

To facilitate disposition of the spool 13 into its normally secured orientation relative to the base 11, the release mechanism 20 of the present invention further comprises a piston 23 interconnected to the cogwheel 21, wherein the piston 23 is structured to normally bias the cogwheel 21 into operative engagement with the release plate 22, in the manner described above. In addition, the release mechanism 20 of a preferred embodiment of the present invention further comprises a biasing element 24 structured to engage at least a portion of the piston 23 with sufficient energy to force the piston 23 towards the release plate 22 thereby forcing the cogwheel 21, which is interconnected to the piston 23, into operative engagement with the release plate 22.

Figure 7:
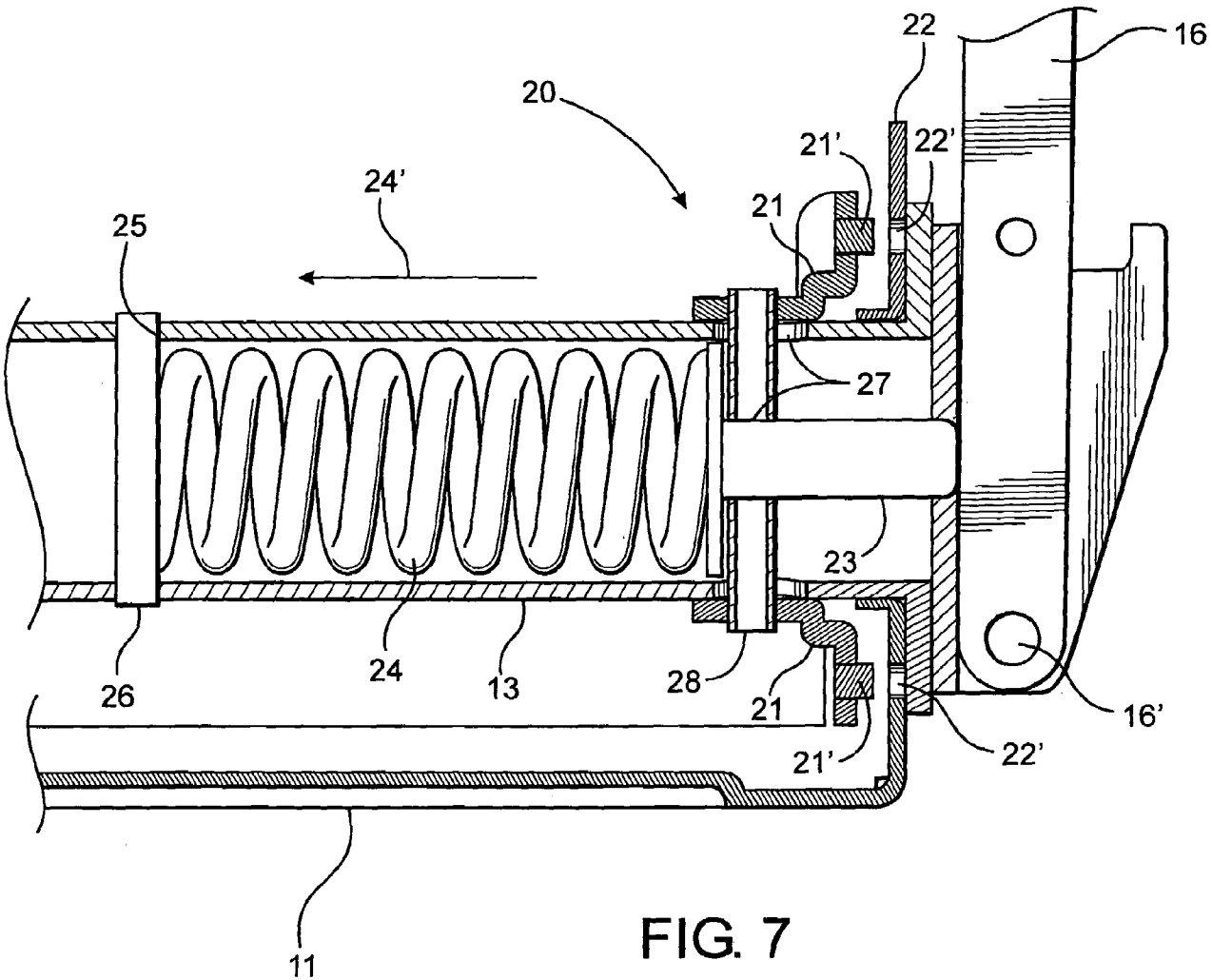
FIG. 7 is the partial cross-sectional elevation of the preferred embodiment of FIG. 6 illustrating an actuator operated to temporarily release the spool from normally secured orientation.

In one preferred embodiment, the release mechanism 20 comprises a piston 23 structured to be at least partially disposed within an interior portion of the spool 13, as illustrated in FIGS. 6 and 7. In addition, the biasing element 24 may comprise a helical spring which is also structured to be disposed within an internal portion of the spool 13. In the preferred embodiment illustrated in the figures, the biasing element 24 comprises a helical spring disposed completely within the interior of the spool 13.

In at least one embodiment, the spool 13 of the present invention comprises a stop channel 25 disposed through at least one portion thereof, and in a preferred embodiment, the spool 13 comprises a stop channel 25 disposed therethrough. The stop channel 25 is structured and disposed to receive a stop 26 therein. More in particular, the stop 26 may comprise a cylindrical pin positioned so as to abut one end of the biasing element 24 and to substantially prevent movement of the biasing element 24 in at least one direction and, more specifically, to prevent movement of the biasing element 24 beyond the stop 26 in the direction indicated by arrow 24, in FIG. 7. In addition, the opposite end of biasing element 24 is structured to engage at least a portion of the piston 23, once again, as illustrated in FIGS. 6 and 7.

In a preferred embodiment, the spool 13 also comprises an interconnector channel 27 which, as with stop channel 25, is preferably disposed therethrough. The interconnector channel 27 is structured to receive an interconnector 28 therein, and the interconnector 28 may comprise a cylindrical pin, similar to stop 26. In addition, the piston 23 and the cogwheel 21 of a preferred embodiment of the present invention also comprise an interconnector channel 27 therethrough, cooperatively structured and disposed to receive the interconnector 28 therein. As will be appreciated from FIGS. 6 and 7, interconnector 28 serves to fixedly interconnect the piston 23 to the cogwheel 21 such that movement of the piston 23 results in a corresponding movement of the cogwheel 21 interconnected thereto. Specifically, movement of the piston 23 a predetermined distance in the direction of either arrow 24' or 24" will result in a corresponding and subsequent movement of cogwheel 21 an equivalent predetermined distance in the same direction.

Additionally, the interconnector 28 serves to movably interconnect the piston 23 and the cogwheel 21 to the spool 13, once again, as illustrated best in FIGS. 6 and 7. Looking to FIG. 6, it may be seen that the interconnector channel 27 comprises an elongated configuration along a portion of a length of the spool 13. It will be appreciated that the elongated configuration of the interconnector channel 27 allows for movement of the interconnector 28, disposed therein, along the portion of the length of the spool 13. Thus, these figures illustrate that movement of the interconnector 28 along the portion of the spool 13 in the direction of either arrow 24' or arrow 24" will necessarily result in movement of the piston 23, and the cogwheel 21 fixedly interconnected thereto, along the length of spool 13 in the same direction. The significance of the fixedly interconnected relationship and unified movement of the piston 23 and the cogwheel 21 will be further appreciated from the following.

In particular, the release mechanism 20 of the present invention comprises an actuator 16 which is operable by a user and is structured to engage a portion of the piston 23 and to force the piston 23 away from the release plate 22 in the direction of arrow 24'. By virtue of the fixedly interconnected relationship between the cogwheel 21 and the piston 23, the cogwheel 21 is also displaced from the release plate 22 in the direction of arrow 24' the same distance as the piston 23 is displaced. More importantly, by virtue of the movably interconnected relationship between the spool 13 and the cogwheel 21, the actuator 16 allows the user to displace the cogwheel 21 so as to release the spool 13 from its normally secured orientation relative to the base 11, thereby at least temporarily allowing the spool 13 to be movable relative to the base 11.

Specifically, the actuator 16 is structured to permit the user to displace the piston 23, and thereby, the cogwheel 21 fixedly interconnected thereto, a predetermined distance away from the release plate 22, in the direction of arrow 24'. This predetermined distance is at least partially defined as being greater than the distance by which any cog 21' is disposed within any corresponding release channel 22'. Therefore, displacement of the cogwheel 21, and thus, displacement of the cogs 21' extending outwardly therefrom, the predetermined distance from the release plate 22 results in the release of the cogs 21 from the operative and interlocking relation with the corresponding release channels 22' of the release plate 22. As will be appreciated, once the cogs 21' of the cogwheel 21 are released from the operative and interlocking relation with the corresponding ones of the release channels 22', the cogwheel 21 is free to move relative to the release plate 22 and, as such, the spool 13, which is moveably interconnected to the cogwheel 21, is also free to move. In one further preferred embodiment, the spool 13 is temporarily free to rotate relative to the base 11 upon operation of the actuator 16 by the user.

Looking again to FIG. 6, it is seen that the actuator 16, in a preferred embodiment of the present invention, is pivotally interconnected to the spool 13 by actuator pin 16'. As such, the user may simply push the actuator 16 towards the spool 13, in the direction of arrow 24', thereby causing the actuator 16 to contact the portion of the piston 23 and force the piston 23 the predetermined distance further into the inner portion of spool 13 in the direction of arrow 24'. As described above, movement of the piston 23 will also cause movement of the cogwheel 21 the predetermined distance away from release plate 22 in the direction of arrow 24', thereby allowing the spool 13 to move freely relative to the base 11.

Thus, operation of the actuator 16 by the user, specifically, pushing the actuator 16 towards the release plate 22 in the direction of arrow 24' into contact with the portion of the piston 23, causes the piston 23 and the cogwheel 21 fixedly interconnected thereto to be displaced away from the release plate 22 the predetermined distance such that each of the plurality of cogs 21' are disposed out of the operative and interlocking relation with the corresponding ones of the plurality of release channels 22' of the release plate 22, as shown in FIG. 7, thereby allowing the spool 13 to be at least temporarily movable relative to the base 11. In one preferred embodiment, the spool 13 is rotatably movable relative to the base 11, since the spool 13 is rotatably supported via the plurality of support channels 15 of each of the support plates 13 of the base 11. While the spool 13 is free to move relative to the base 11, the user may move the actuator 16 in either direction to rotate the spool 13 to either take up or let out a portion of an elongated member 18 such as, for example, a rope, cable, wire, line, etc., thereby raising or lowering an object attached thereto via one or more attachment member 19, such as a hook, clip, or clasp affixed to a free end of the elongated member 18.

Conversely, when the actuator 16 in not being operated, i.e., the actuator 16 is not being forced into contact with the portion of the piston 23 in the direction of arrow 24', the biasing element 24 acts to force the piston 23, and the cogwheel 21 fixedly interconnected thereto, towards the release plate 22 in the direction of arrow 24", as in FIG. 6. More in particular, in a preferred embodiment, the biasing element 24 is structured to force the piston 23 towards the release plate 22 with sufficient force such that the cogs 21' of the cogwheel 21 are forced into the operative and interlocking relation with the corresponding release channels 22' of the release plate 22. Once again, by virtue of the moveably interlocking relation between the cogwheel 21 and the spool 13, the spool is thereby disposed into its normally secured and immobile relation relative to the base 11.

At least one embodiment of the present invention comprises a ladder, as shown at 30 in FIG. 8, having a plurality of rungs 32 structured to support a user thereupon. In this preferred embodiment of the present invention, the ladder hoist assembly 10' includes base 11 structured to be mounted to at least one of the plurality of rungs 32 of the ladder 30, as illustrated in the FIG. 8. In this preferred embodiment, at least one pulley member 34 is attached to one of the plurality of rungs 32 of the ladder 30, and in a preferred embodiment, the at least one pulley member 34 is disposed in a position above where the base 11 is mounted to the ladder 30. FIG. 8 further illustrates, in this preferred embodiment, the ladder hoist assembly 10' comprises an elongated member 18 which is structured and disposed to extend upwardly from the base 11 into engagement with the pulley member 34 and downward to be attached to one or more objects via at least one attachment member 19, such that the object(s) may be raised or lowered by the user utilizing the ladder hoist assembly 10', without assistance.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A hoist assembly structured to be utilized with a ladder, said assembly comprising:

a base structured to be mounted to the ladder, said base comprising a release plate, a spool interconnected to said base, said spool structured and disposed in a normally secured orientation relative to said base, a release mechanism structured to retain said spool in said normally secured orientation relative to said base, said release mechanism comprising a cogwheel movably interconnected to said spool, said cogwheel structured to be normally disposed in an operative engagement with said release plate, said release mechanism comprising an actuator operable by a user to release said spool from said normally secured orientation to temporarily allow said spool to be movable relative to said base, said release mechanism further structured to return said spool to said normally secured orientation relative to said base upon release of said actuator by the user, and an elongated member interconnected to said spool and being movable therewith.

2. The assembly as recited in claim 1 wherein said release plate comprises at least one release channel thereon.

3. The assembly as recited in claim 2 wherein said cogwheel comprises at least one cog and said operative engagement is at least partially defined by said at least one cog disposed in an interlocking relation with said at least one release channel to retain said spool in said normally secured orientation relative to said base.

4. The assembly as recited in claim 3 wherein said release mechanism further comprises a piston interconnected to said cogwheel, said piston structured to normally bias said cogwheel into said operative engagement with said release plate.

5. The assembly as recited in claim 4 wherein said release mechanism further comprises a biasing element structured to engage a portion of said piston and force said piston towards said release plate thereby normally biasing said cogwheel interconnected to said piston into said operative engagement with said release plate.

6. The assembly as recited in claim 5 wherein said actuator is operable by a user to engage and force said piston away from said release plate and to dispose said cogwheel fixedly interconnected to said piston a predetermined distance away from and out of said operative engagement with said release plate thereby temporarily allowing said spool to be movable relative to said base.

7. The assembly as recited in claim 6 wherein said piston is structured to normally bias said cogwheel into said operative engagement with said release plate upon release of said actuator by the user.

8. A hoist assembly structured to be utilized with a ladder, said assembly comprising:

a base structured to be mounted to the ladder, a spool interconnected to said base, said spool structured and disposed in a normally secured orientation relative to said base, said base comprising a plurality of spool supports each having a support channel structured to receive a portion of said spool movably therein, a release mechanism structured to retain said spool in said normally secured orientation relative to said base, at least one of said plurality of spool supports comprising a release plate having a plurality of release channels disposed thereon, said release mechanism comprising a cogwheel movably interconnected to said spool and having a plurality of cogs extending outwardly therefrom, said cogwheel structured to be normally disposed in an operative engagement with said release plate, said operative engagement being at least partially defined by each of said plurality of cogs being disposed in an interlocking relation with a corresponding one of said plurality of release channels, said release mechanism comprising a piston fixedly interconnected to said cogwheel, said piston structured to normally bias said cogwheel into said operative engagement with said release plate, said release mechanism further comprising a biasing element structured to engage a portion of said piston and force said piston towards said release plate thereby normally biasing said cogwheel fixedly interconnected to said piston into said operative engagement with said release plate, said release mechanism further comprising an actuator operable by a user to release said spool from said normally secured orientation to temporarily allow said spool to be movable relative to said base, said release mechanism further structured to return said spool to said normally secured orientation relative to said base upon release of said actuator by the user, and an elongated member interconnected to said spool and being movable therewith.

9. The assembly as recited in claim 8 wherein said actuator is operable by a user to engage and force said piston away from said release plate and to dispose said cogwheel fixedly interconnected to said piston a predetermined distance away from and out of said operative engagement with said release plate thereby temporarily allowing said spool to be movable relative to said base.

10. The assembly as recited in claim 8 wherein said spool is rotatably movable relative to said base.

11. The assembly as recited in claim 8 wherein said interlocking relation is at least partially defined by said plurality of cogs extending into said corresponding ones of said plurality of release channels on said release plate.

12. The assembly as recited in claim 11 wherein said interlocking relation is further defined by said plurality of cogs extending into said corresponding ones of said plurality of release channels, said plurality of cogs being immovable therefrom unless said cogwheel is disposed said predetermined distance from said release plate.

13. A ladder hoist assembly comprising:

a ladder having a plurality of rungs and being structured to support a user thereupon, a base comprising at least one mounting channel structured to facilitate mounting said base to at least one of said plurality of rungs of said ladder, at least one mounting member structured to cooperatively associate with said mounting channel and said at least one of said plurality of rungs of said ladder to facilitate securely mounting said base to said ladder, a spool interconnected to said base, said spool structured and disposed in a normally secured orientation relative to said base, said base comprising a plurality of spool supports each comprising a support channel structured to receive a portion of said spool movably therein, a release mechanism structured to retain said spool in said normally secured orientation relative to said base, at least one of said spool supports comprising a release plate having a plurality of release channels disposed thereon, said release mechanism comprising a cogwheel having a plurality of cogs extending outwardly therefrom, said cogwheel structured to be normally disposed in an operative engagement with said release plate, said operative engagement being at least partially defined by each of said plurality of cogs being disposed in an interlocking relation with a corresponding one of said plurality of release channels, said release mechanism comprising a piston interconnected to said cogwheel, said piston structured to normally bias said cogwheel into said operative engagement with said release plate, said release mechanism further comprising a biasing element structured to engage a portion of said piston and force said piston towards said release plate thereby normally biasing said cogwheel interconnected to said piston into said operative engagement with said release plate, said release mechanism comprising an actuator operable by the user to release said spool from said normally secured orientation to temporarily allow said spool to be movable relative to said base, said release mechanism further structured to return said spool to said normally secured orientation relative to said base upon release of said actuator by the user, an elongated member secured at one end to said spool and being movable therewith, at least one pulley member attached to one of said plurality of rungs of said ladder and positioned above said base, and said elongated member structured and disposed to extend upwardly from said base into engagement with said pulley member and downward to attach to an object to be raised by the user utilizing said ladder hoist assembly.

14. The assembly as recited in claim 13 wherein said interlocking relation is at least partially defined by said plurality of cogs extending into said corresponding ones of said plurality of release channels on said release plate.

15. The assembly as recited in claim 13 wherein said spool comprises a stop channel and said release mechanism comprises a stop, said stop being disposed in said stop channel and structured to prevent movement of said biasing element in at least one direction.

16. The assembly as recited in claim 13 further comprising an interconnector, said interconnector structured to fixedly interconnect said cogwheel and said piston such that said cogwheel is movable with said piston.

17. The assembly as recited in claim 16 wherein said spool comprises an interconnector channel structured to receive said interconnector therein.

18. The assembly as recited in claim 17 wherein said interconnector channel comprises an elongated configuration disposed lengthwise along a portion of a length of said spool, said interconnector channel structured to permit said interconnector to move within said interconnector channel along said portion of said length of said spool, thereby allowing said piston and said cogwheel fixedly interconnected thereto to be movable along said portion of said length of said spool.

19. The assembly as recited in claim 18 wherein said actuator is operable to displace said piston and said cogwheel fixedly interconnected thereto along said portion of said length of said spool away from said release plate a predetermined distance thereby temporarily allowing said spool to be rotatably movable relative to said base.

20. The assembly as recited in claim 19 wherein said piston and said cogwheel interconnected thereto move along said portion of said length of said spool towards said release plate upon release of said actuator by the user thereby returning said spool to said normally secured orientation relative to said base.

* * * * *